US006852477B2

(12) United States Patent
Haye et al.

(10) Patent No.: US 6,852,477 B2
(45) Date of Patent: Feb. 8, 2005

(54) PHOTOGRAPHIC PERACID BLEACHING COMPOSITION, PROCESSING KIT, AND METHOD OF USE

(75) Inventors: Shirleyanne E. Haye, Rochester, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/691,083

(22) Filed: Oct. 22, 2003

(65) Prior Publication Data

US 2004/0171506 A1 Sep. 2, 2004

Related U.S. Application Data

(62) Division of application No. 10/376,717, filed on Feb. 28, 2003, now Pat. No. 6,703,192.

(51) Int. Cl.[7] ..... G03C 7/42
(52) U.S. Cl. ..... 430/450; 430/460; 430/461
(58) Field of Search ..... 430/450, 461, 430/460

(56) References Cited

U.S. PATENT DOCUMENTS

| | | | | |
|---|---|---|---|---|
| 4,277,556 | A | 7/1981 | Koboshi et al. | 430/393 |
| 4,301,236 | A | 11/1981 | Idota et al. | 430/393 |
| 4,328,306 | A | 5/1982 | Idota et al. | 430/306 |
| 4,448,878 | A | 5/1984 | Yamamuro et al. | 430/507 |
| 4,454,224 | A | 6/1984 | Brien et al. | 430/393 |
| 4,458,010 | A | 7/1984 | Yamamuro et al. | 430/393 |
| 4,481,290 | A | 11/1984 | Kishimoto et al. | 430/543 |
| 4,506,007 | A | 3/1985 | Nakajima et al. | 430/393 |
| 4,508,816 | A | 4/1985 | Yamamuro et al. | 430/393 |
| 4,717,649 | A | 1/1988 | Hall et al. | 430/460 |
| 4,873,180 | A | 10/1989 | Marchesano et al. | 430/491 |
| 5,318,880 | A | 6/1994 | English et al. | 430/393 |
| 5,451,491 | A | 9/1995 | Szajewski et al. | 430/393 |
| 5,460,924 | A | 10/1995 | Buchanan et al. | 430/393 |
| 5,464,728 | A | 11/1995 | Szajewski et al. | 430/393 |
| 5,508,151 | A | 4/1996 | O'Toole et al. | 430/393 |
| 5,510,232 | A | 4/1996 | O'Toole | 430/430 |
| 5,521,056 | A | 5/1996 | Buchanan et al. | 430/430 |
| 5,538,834 | A | 7/1996 | Buchanan et al. | 430/377 |
| 5,541,041 | A | 7/1996 | Haye | 430/393 |
| 5,547,816 | A | 8/1996 | Fyson et al. | 430/393 |
| 5,550,009 | A | 8/1996 | Haye et al. | 430/393 |
| 5,554,491 | A | 9/1996 | O'Toole et al. | 430/393 |
| 5,578,428 | A | 11/1996 | Fyson | 430/398 |
| 5,614,355 | A | 3/1997 | Haye et al. | 430/430 |
| 5,641,615 | A | 6/1997 | Haye et al. | 430/430 |
| 5,641,616 | A | 6/1997 | Bertucci et al. | 430/430 |
| 5,656,416 | A | 8/1997 | O'Toole | 430/461 |
| 5,683,858 | A | 11/1997 | Fyson | 430/393 |
| 5,691,112 | A | 11/1997 | Watnabe et al. | 430/270.1 |
| 5,691,118 | A | 11/1997 | Haye | 430/357 |
| 5,691,122 | A | 11/1997 | O'Toole | 430/430 |
| 5,763,147 | A | 6/1998 | Haye et al. | 430/393 |
| 5,773,202 | A | 6/1998 | Haye et al. | 430/393 |
| 5,885,758 | A | 3/1999 | Bertucci et al. | 430/430 |
| 5,972,579 | A | 10/1999 | Bertucci et al. | 430/430 |
| 5,972,582 | A | * 10/1999 | Gamble et al. | 430/458 |
| 5,972,583 | A | 10/1999 | Bertucci et al. | 430/461 |

FOREIGN PATENT DOCUMENTS

| | | |
|---|---|---|
| EP | 0 428 101 B1 | 9/1996 |
| EP | 0 747 764 A1 | 12/1996 |
| WO | WO 92/01972 | 2/1992 |
| WO | WO 92/007300 | 4/1992 |

* cited by examiner

*Primary Examiner*—Hoa Van Le
(74) *Attorney, Agent, or Firm*—J. Lanny Tucker

(57) ABSTRACT

A composition for photographic bleaching contains a peracid bleaching agent such as a peroxide, persulfate, or periodate, and a cyclicaminomethanediphosphonic acid or a salt thereof as a stabilizing compound. This bleaching composition can also include a fixing agent, and can be used to provide color photographic images in various color photographic materials.

11 Claims, No Drawings

PHOTOGRAPHIC PERACID BLEACHING COMPOSITION, PROCESSING KIT, AND METHOD OF USE

CROSS-REFERENCE TO RELATED APPLICATION

This is a Divisional of application Ser. No. 10/376,717, filed Feb. 28, 2003, now U.S. Pat. No. 6,703,192.

FIELD OF THE INVENTION

In general, this invention relates to photography and to photographic processing compositions and methods used to provide color images in color photographic materials. In particular, it relates to a photographic bleaching composition containing a peracid bleaching agent and a specific polyphosphonic acid. It also relates to photographic processing kits and methods of use for the bleaching composition.

BACKGROUND OF THE INVENTION

The basic image-forming process of color silver halide photography comprises the exposure of a silver halide color photographic recording material to actinic radiation (such as light) and the manifestation of a useful image by wet chemical processing of the material. The fundamental steps of this wet processing include color development to reduce silver halide to silver and to produce dye images in exposed areas of the material. During or after bleaching to oxidize metallic silver to silver (I), the silver ion is generally removed by dissolving it in a silver solvent, commonly known as a fixing agent.

The most common bleaching agents for color photographic processing are complexes of ferric [Fe (III)] ion and various organic chelating ligands (such as aminopolycarboxylic acids), of which there are hundreds of possibilities, all with varying photographic bleaching abilities and biodegradability.

Less common bleaching agents are what are known as peracids including the most common peracid, hydrogen peroxide. These bleaching agents provide some advantages over the more common ferric ion-ligand complexes including reduced environmental concerns. Numerous publications describe peroxide, persulfate, and other peracid bleaching agents and their use in photographic processing. See for example U.S. Pat. No. 5,451,491 (Szajewski et al.), U.S. Pat. No. 5,460,924 (Buchanan et al.), U.S. Pat. No. 5,464,728 (Szajewski et al.), U.S. Pat. No. 5,508,151 (O'Toole et al.), U.S. Pat. No. 5,510,232 (O'Toole), U.S. Pat. No. 5,521,056 (Buchanan et al.), U.S. Pat. No. 5,538,834 (Buchanan et al.), U.S. Pat. No. 5,541,041 (Haye), U.S. Pat. No. 5,547,816 (Fyson et al.), U.S. Pat. No. 5,550,009 (Haye et al.), U.S. Pat. No. 5,554,491 (O'Toole et al.), U.S. Pat. No. 5,578,428 (Fyson), U.S. Pat. No. 5,614,355 (Haye et al.), U.S. Pat. No. 5,641,615 (Haye et al.), U.S. Pat. No. 5,641,616 (Haye et al), U.S. Pat. No. 5,656,416 (O'Toole et al.), U.S. Pat. No. 5,683,858 (Fyson), U.S. Pat. No. 5,691,118 (Haye), U.S. Pat. No. 5,691,112 (O'Toole), U.S. Pat. No. 5,763,147 (Haye et al.), and U.S. Pat. No. 5,773,202 (Haye et al.).

Throughout the photographic industry, there is a desire to provide photographic processing solutions that are safe and easy to use, photographically effective, and environmentally acceptable. One desirable property is that the solutions are not objectionable due to unpleasant odors. In addition, there is a need to stabilize some of the peracid bleaching agents that can decompose upon long-term storage or use and providing rapid bleaching.

Despite the many useful photographic bleaching solutions and processing methods known in the art, there is a continuing need for a highly effective photographic bleaching composition containing a peracid bleaching agent that has improved stability.

SUMMARY OF THE INVENTION

The present invention provides an advance in the photographic art with a composition for photographic bleaching comprising at least 0.005 mol/l of a peracid bleaching agent or a compound that generates or provides a peracid bleaching agent, and at least 0.00005 mol/l of a cyclicaminomethanediphosphonic acid or a salt thereof.

In preferred embodiments of this invention, a composition for photographic bleaching has a pH of from about 1 to about 11, and comprises:

from about 0.01 to about 3 mol/l of hydrogen peroxide or a compound that provides hydrogen peroxide as a photographic bleaching agent, from about 0.0001 to about 0.25 mol/l of morpholinomethanediphosphonic acid or a salt thereof, and optionally, one or more additional polyaminopolyphosphonic acids or salts thereof.

This invention also provides a photographic processing kit comprising:

A) a first composition comprising a peracid bleaching agent or a compound that generates or provides a peracid bleaching agent, and B) a second composition comprising a cyclicaminomethanediphosphonic acid or a salt thereof.

These compositions in the kit can be in liquid or solid form.

In addition, a method of providing a color image comprises contacting a color photographic material with a composition for photographic bleaching comprising at least 0.005 mol/l of a peracid bleaching agent or a compound that generates or provides a peracid bleaching agent, and at least 0.00005 mol/l of a cyclicaminomethanediphosphonic acid or a salt thereof.

In preferred embodiments, a method of photographic processing comprises:

A) contacting a color photographic material with a color developing composition, and B) contacting the color photographic material with a composition for photographic bleaching comprising at least 0.005 mol/l of a peracid bleaching agent or a compound that generates or provides a peracid bleaching agent, and at least 0.00005 mol/l of a cyclicaminomethanediphosphonic acid or a salt thereof.

This invention includes aqueous peracid bleaching compositions (solutions or compounds) containing peracids in combination with a cyclicaminomethanediphosphonic acid, such as morpholinomethanediphosphonic acid, alone or in combination with other sequestering agents at either acidic or alkaline pH conditions. These compositions have reduced odor and can be used for the bleaching of a wide variety of silver halide based photographic materials.

DETAILED DESCRIPTION OF THE INVENTION

Photographic bleaching is carried out according to the present invention in one or more steps using one or more peracid photographic bleaching agents as the first essential component of the bleaching composition. Such compounds include, but are not limited to, the hydrogen, alkali and alkaline earth salts of persulfate, peroxide, perchlorate, perborate, periodate, perphosphate, percarbonate, chlorate, bromate, iodate, and metaperiodate. These bleaching agents can be formulated as described, for example, in *Research Disclosure* September 1994, Item 36544 published by Kenneth Mason Publications, Ltd., Dudley House, 12 North Street, Emsworth, Hampshire PO10 7DQ, England (also available from Emsworth Design, 147 West 24th Street, New York, N.Y. 10011), and the patents listed in the "Background" above, all of which are incorporated herein by reference.

Especially useful peracids are peroxides, persulfates, and periodates. Sodium persulfate and hydrogen peroxide are most preferred bleaching agents.

Compounds that generate or provide a suitable peracid can be present in the compositions and kits of this invention. For examples, precursors of hydrogen peroxide are well known in the art and include, for example, perborates, perphosphates, percabonates, percarboxylates, and hydrogen peroxide urea. In addition, hydrogen peroxide can be generated within a solution by electrolysis.

The second essential component of the compositions and kits of this invention that appear to act as "stabilizing" compounds are cyclicaminomethanediphosphonic acid (and salts thereof), or mixtures thereof, as described in U.S. Pat. No. 4,873,180 (Marchesano et al.). "Cyclicamino" groups comprise 3- to 6-membered rings, including but not limited to substituted or unsubstituted aziridino, pyrrolidino, imidazolidino, piperidino, piperazino, isoindolino, and morpholino groups. The substituted or unsubstituted morpholino groups are preferred. Suitable substituents for the cyclicamino groups include, but are not limited to, alkyl groups having 1 to 4 carbon atoms, halo groups, nitro groups, cyano groups, aryl groups, alkoxy groups having 1 to 4 carbon atoms, aryloxy groups, sulfamoyl groups, acyloxy groups, acylamino groups, ureido groups, sulfonamido groups, hydroxy groups, and others that would be readily apparent to one skilled in the art from the teaching of U.S. Pat. No. 4,873,180, incorporated herein by reference.

The "cyclicamino" groups are attached to a methyl group that includes two phosphonic acids (or alkali metal or ammonium salts thereof) and the remaining valence of the methyl group can be hydrogen, a substituted or unsubstituted alkyl group, or a substituted or unsubstituted aryl group.

Representative cyclicaminomethanediphosphonic acids (or salts thereof) are compounds 7–17 of U.S. Pat. No. 4,873,180 (noted above). A most preferred compound of this type is morpholinomethanediphosphonic acid or a salt thereof that is commercially available as BUDEX™ 5103 from Budenheim (Germany).

The bleaching compositions can include a variety of optional chemical components that provide one or more chemical or physical functions, including but not limited to, buffers, rehalogenating agents, metal ion sequestering agents, bleach accelerating agents, biocides, photographic hardeners, and other materials readily apparent to one skilled in the art.

It is particularly useful to include one or more buffers in the bleaching composition (when in aqueous form) to maintain the pH of up to 13 (preferably from about 1 to about 11).

If the bleaching composition of this invention is highly acidic, that is having a pH less than 2 (preferably less than 1.5, and more preferably, less than 1.25), the pH can be provided by adding at least one conventional strong acid, including, but not limited to, sulfuric acid, phosphoric acid and methanesulfonic acid. Sulfuric acid is preferred.

If the pH of the bleaching composition is between 3 and 6, the pH may be maintained with any of a variety of organic or inorganic buffers, as long as the buffer has at least one pKa value between 1.5 and 7.5 (preferably 3 to 6) and does not substantially disrupt the complexation of ferric ion by the pyridinecarboxylate ligand. Furthermore, the buffer should not be readily oxidized by the bleaching composition nor should it adversely affect image and masking dyes. It is to avoid such dye interactions that preferred buffers such as aliphatic or aromatic carboxylic acid buffers, and particularly sulfo-substituted aliphatic and aromatic carboxylic acid buffers are used at concentrations and pH values such that the concentration of the basic form of the buffer (for example, acetate ion) is less than 0.5 mol/l, and more preferably less than 0.2 mol/l. Examples of useful buffers are acetate, 2-methyllactate, phthalate, 4-sulfophthalate, 5-sulfoisophthalic acid, sulfoacetate, sulfosuccinate, and trimellitate. In one embodiment, the ligand may also serve as the buffer.

If the bleaching composition is alkaline that is having a pH within the general range of from about 7 to about 13 (with a pH of from about 8 to about 12 being preferred, and a pH of from about 9 to about 11 being most preferred), the pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, β-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium and potassium carbonates are preferred. The amount of useful buffer or base would be readily apparent to one skilled in the art.

It may also be desirable to include a rehalogenating agent in the bleaching composition including but not limited to, chloride and/or bromide ions.

It may further be desirable to include one or more uncomplexed (poly)amino(poly)carboxylic acid, an additional polyphosphonic acid, or a salt of either of these compounds in the bleaching compositions. Particularly useful polyaminopolyphosphonic acids or salts thereof can be represented by the following Structure I:

I

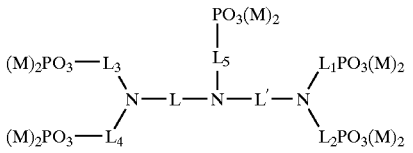

wherein L, L', $L_1$, $L_2$, $L_3$, $L_4$ and $L_5$ are independently divalent aliphatic linking groups independently having from 1 to 4 carbon, oxygen, sulfur or nitrogen atoms in the linking group chain, and M is hydrogen or a monovalent cation.

A particularly useful polyaminopolyphosphonic acid or salt thereof is diethylenetriaminepentamethylenephosphonic acid or a salt thereof.

The following TABLE I lists the general and preferred amounts of the essential and some optional components of the bleaching compositions of this invention. The preferred ranges are listed in parentheses ( ), and all of the ranges are considered to be approximate or "about" in the upper and lower end points. During processing, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I

| COMPONENT | CONCENTRATIONS |
|---|---|
| Peracid bleaching agent(s) | 0.005–5 mol/l (0.01–3 mol/l) |
| Rehalogenating agent(s) | 0–2 mol/l (0.01–1 mol/l) |
| Buffering agent(s) | 0.05–3 mol/l (0.1–2 mol/l) |
| Cyclicaminomethane-diphosphonic acid (or salt) | 0.00005–0.5 mol/l (0.0001–0.25 mol/l) |
| pH | Up to 13 (1–11) |

The bleaching compositions of this invention can be bleach-fixing compositions that also include one or more photographic fixing agents such as the thiosulfate or thiocyanates as described below. Thiosulfates are particularly useful fixing agents and can be present in an amount of at least 0.005 mol/l. The fixing agent is particularly useful in the second composition of the photographic processing kit of this invention.

The components of the bleaching composition can be mixed together in any suitable order. The compositions can be stored for a time or used immediately as liquid or solid formulations. They can be formulated in aqueous concentrates or working strength solutions, and diluted if necessary before use. Alternatively, they can be formulated as solid compositions in the form of powders, tablets, granules, or pellets and added to a processing vessel or replenishment tank in a suitable manner at a suitable rate.

During photographic processing, conventional procedures can be used for replenishment of the various processing solutions, including the photographic bleaching composition of this invention. Preferably, the rate of bleaching solution replenishment is not more than 3000 ml/m$^2$, and preferably from about 250 to about 1500 ml/m$^2$ of processed photographic material. The processing equipment can be any suitable processor having one or more processing tanks or vessels, including minilab processors and larger scale processors. The bleaching step can be carried out in one or more tanks or stages arranged in concurrent or countercurrent flow.

The present invention can be used advantageously with any of the known methods of applying photographic bleaching compositions to photographic materials. These methods include, but are not limited to, immersing the material into an aqueous bleaching composition (with or without agitation or circulation), bringing the material into contact with a web or drum surface that is wet with the bleaching composition, laminating the material with a cover sheet or web in such a way that the composition is brought into contact with the material, or applying the bleaching composition to the material by high velocity jet or spray.

Each bleaching step can be generally carried out at a temperature of from about 20 to about 65° C. (preferably from about 30 to about 60° C.). The time of processing is generally up to 600 seconds and preferably at least 10 and up to 400 seconds (more preferably from about 10 to about 240 seconds).

The other processing steps desired to provide color images can be similarly rapid or conventional in time and conditions. Preferably the other processing steps, such as color development, fixing, and/or stabilizing (or rinsing), are likewise shorter than conventional times. For example, color development can be carried out for from about 12 to about 360 seconds, a fixing step for from about 12 seconds to about 8 minutes, and stabilizing (or rinsing) for from about 15 to about 240 seconds in various processing protocols. The bleaching step can be carried out more than once in some processing methods. The processing methods can have any of a wide number of arrangements of steps, as described for example in U.S. Pat. No. 5,633,124 (Schmittou et al.) that is incorporated herein by reference.

In rapid processing methods, the total processing time for bleaching can be up to 100 seconds (preferably from about 40 to about 100 seconds).

The present invention can therefore be used to process silver halide materials of various types including color papers (for example using Process RA-4), color motion picture prints (for example using Process ECP), and color positive films (for example using Process E-6), and color negative films (for example using Process C-41). The various processing sequences, conditions and solutions for these processing methods are well known in the art, as well as obvious modifications thereof.

An acidic stop solution can be used between color development and the first bleaching step. The "stop" solution generally is an aqueous solution having a pH below 7.

Thus, one preferred processing method of the present invention for obtaining color images in photographic materials includes the following individual processing steps, in order: color development, bleaching, fixing, and final rinsing or stabilizing.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 noted above. Included within such teachings in the art is the use of various classes of cyan, yellow and magenta color couplers that can be used with the present invention (including pyrazolone and pyrazolotriazole type magenta dye forming couplers). Preferably, the present invention can be used to process color photographic papers having pigmented resin-coated paper supports.

The emulsions and other components, and structure of color photographic materials processed using this invention and the various procedures for manufacturing them are well known and described in considerable publications, including, for example, *Research Disclosure*, publication 38957, pages 592–639 (September 1996), and *Research Disclosure*, Volume 370, February 1995, and hundreds of references noted therein. Research Disclosure is a publication of Kenneth Mason Publications Ltd., Dudley House, 12 North Street, Emsworth, Hampshire PO10 7DQ England (also available from Emsworth Design Inc., New York, N.Y. 10011). This reference will be referred to hereinafter as "Research Disclosure". More details about such materials are provided herein below. In particular, the invention can be practiced with photographic color papers containing any of many varied types of silver halide crystal morphology, sensitizers, color couplers, and addenda known in the art, as described in the noted Research Disclosure publication and the many publications noted therein. The color papers can have one or more layers, at least one of which is a silver halide emulsion layer that is sensitive to electromagnetic radiation, disposed on a suitable resin-coated paper support. The supports can be subbed or unsubbed and coated with various antihalation, antistatic, or other non-imaging layers as is known in the art.

Representative photographic materials that can be processed to advantage using the present invention include, but are not limited to, KODAK ROYAL GOLD® Color Films (especially the 1000 speed color film), KODAK GOLD MAX® Color Films, KODAK ADVANTIX® Color Films, KODAK VERICOLOR® III Color Films, KONICA VX400 Color Film, KONICA Super SR400 Color Film, KONICA CENTURIA Color Negative Films, FUJI SUPERIA and NEXIA Color Films, and LUCKY Color Films. Other elements that could be used in the practice of this invention would be readily apparent to one skilled in the art.

More preferably, the present invention can be used to provide color images in photographic color papers including, but not limited to, the following commercial products: KODAK® SUPRA ENDURA Color Papers, KODAK® PORTRA ENDURA Color Papers, KODAK® EKTACOLOR® EDGE 5, 7 and 8 Color Papers (Eastman Kodak Company), KODAK® ROYAL® VII Color Papers (Eastman Kodak Company), KODAK® PORTRA III, IIIM Color Papers (Eastman Kodak Company), KODAK® SUPRA III and IIIM Color Papers (Eastman Kodak Company), KODAK® ULTRA III Color Papers (Eastman Kodak Company), Fujicolor Super Color Papers (Fuji Photo Co., FA5, FA7, FA9, Type D and Type DII), Fujicolor Crystal Archive Color Papers (Fuji Photo Co., Digital Paper Type DP, Professional Paper Type DP, Professional Type CD, Professional Type CDII, Professional Type PD, Professional Type PDII, Professional Type PIII, Professional Type SP, Type One, Professional Paper Type MP, Type D and Type C), Fuji Prolaser (Fuji Photo Co.), KONICA COLOR QA Color Papers (Konica, Type QA6E and QA7, Type AD Amateur Digital, Type CD Professional Digital), Konica Color Paper Professional SP (Konica), Konica Color Paper Professional HC (Konica), Konica Color Paper Professional for Digital Type CD (Konica), Agfa Prestige Color Papers (AGFA, Digital and Prestige II), Agfa Laser II Paper (AGFA), Agfa Professional Portrait (AGFA), Agfa Professional Signum II (AGFA), Mitsubishi Color Paper SA Color Papers (Mitsubishi, Type SA-C, Type SA-PRO-L and Type SA-PRO-H). The compositions and constructions of such commercial photographic color papers would be readily determined by one skilled in the art.

KODAK® DURATRANS®, KODAK® DURACLEAR, KODAK® EKTAMAX RA and KODAK® DURAFLEX transparent photographic color positive materials and KODAK® Digital Paper Type 2976 can also be processed using the present invention.

Reagents for color development compositions are well known, and described, for example, in Research Disclosure (noted above), sections XVIII and XIX, and the many references described therein. Thus, besides a color developing agent (such as a p-aminophenol or p-phenylenediamine), the color developers can include one or more buffers, antioxidants (or preservatives, such as sulfo-, carboxy, and hydroxy-substituted mono- and dialkylhydroxylamines), antifoggants, fragrances, solubilizing agents, brighteners, halides, sequestering agents, and other conventional addenda. Representative teaching about color developing compositions can also be found in U.S. Pat. No. 4,170,478 (Case et al.), U.S. Pat. No. 4,264,716 (Vincent et al.), U.S Pat. No. 4,482,626 (Twist et al.), U.S. Pat. No. 4,892,804 (Vincent et al.), U.S. Pat. No. 5,491,050 (Brust et al.), U.S. Pat. No. 5,709,982 (Marrese et al.), U.S. Pat. No. 6,037,111 (Haye et al.), U.S. Pat. No. 6,017,687 (Darmon et al.), U.S. Pat. No. 6,077,651 (Darmon et al.), and U.S. Ser. No. 09/706,474 (filed Nov. 3, 2000 by Arcus et al.), all incorporated herein by reference.

A preferred photographic color developing composition has a pH of from about 9.5 to about 13 and comprises 4-(N-ethyl-N-2-methanesulfonylaminoethyl)-2-methylphenylenediamine sesquisulfate (KODAK Color Developing Agent CD-3), one or more hydroxylamine derivatives as antioxidants, and various addenda commonly included in such compositions.

Fixing can be carried out using conventional fixing compositions that generally include one or more thiosulfate fixing agents in conventional amounts. The thiosulfate can be any of sodium thiosulfate, potassium thiosulfate, ammonium thiosulfate, lithium thiosulfate, calcium thiosulfate, or magnesium thiosulfate, or mixtures thereof such that a desired concentration of thiosulfate ion is provided. Preferably, ammonium thiosulfate or sodium thiosulfate (or a mixture thereof) is used. For rapid fixing, ammonium thiosulfate is preferably used.

Optionally, one or more thiocyanate fixing agents can also be present as a fixing agent especially for more rapid silver removal. If present, it can be provided as sodium thiocyanate, potassium thiocyanate, or ammonium thiocyanate, or mixtures thereof.

A particularly useful photographic fixing composition has a pH of from about 2 to about 9 and comprises ammonium thiosulfate as the fixing agent, sulfite ions, and a buffer such as a phthalic acid or a salt thereof as described above.

Stabilizing or rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gonnel), U.S. Pat. No. 4,923,782 (Schwartz), U.S. Pat. No. 4,927,746 (Schwartz), U.S. Pat. No. 5,278,033 (Hagiwara et al.), U.S. Pat. No. 5,441,852 (Hagiwara et al.), U.S. Pat. No. 5,529,890 (McGuckin et al.), U.S. Pat. No. 5,534,396 (McGuckin et al.), U.S. Pat. No. 5,578,432 (McGuckin et al.), U.S. Pat. No. 5,645,980 (McGuckin et al.), and U.S. Pat. No. 5,716,765 (McGuckin et al.), all incorporated herein by reference.

The photographic bleaching composition of this invention can be provided in any suitable container, and can also be included in a processing kit with one or more other processing compositions (such as a color developing composition) in suitable containers.

The processing methods of the present invention can be carried out using any suitable processing equipment or machine that include suitable processing chambers or containers, metering pumps, plumbing, and transport rollers if necessary.

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al) and publications noted therein.

Generally, the bleaching composition of this invention is formulated by mixing two or three "parts" or individual solutions that are manufactured, transported, and stored separately or as bleaching "kits" prior to use. Thus, bleaching kit of this invention can include a first "part" or solution that includes the peracid bleaching agent and a second "part" or solution that includes the cyclicaminomethanediphosphonic acid (or salt thereof). The solutions can be mixed in a suitable manner prior to or during photographic processing.

The color images obtained using the present invention can be further processed electronically through conventional digital means, transmitted, modified, or stored in digital or physical form.

The following examples are provided to illustrate the practice of the present invention and are not meant to be limiting in any way.

EXAMPLE 1

In this example, the alkaline peroxide bleach formulations, shown in TABLE I below, was prepared and stored in open glass containers at room temperature for over 7 days. A decrease in volume due to evaporation was compensated for by periodically adding deionized water. The solutions were analyzed periodically for the amount of remaining peroxide and the change in pH. The results of these measurements are shown in the following TABLE II.

TABLE I

| Component | Formulation (mol/l) | |
|---|---|---|
| | Control A | Example 1 |
| Hydrogen peroxide (30%) | 0.98 | 0.98 |
| Sodium chloride | 0.35 | 0.35 |
| Sodium carbonate buffer | 0.05 | 0.05 |
| 1-Hydroxyethylidene-1,1-diphosphonic acid (DEQUEST ® 2010) | 0.0025 | 0 |
| Morpholinomethanediphosphonic acid (BUDEX ™ 5103) | 0 | 0.0025 |
| pH | 10 | 10 |

TABLE II

| Time | % $H_2O_2$ Remaining | |
|---|---|---|
| (hours) | Control A | Example 1 |
| 0 | 100 | 100 |
| 24 | 96.0 | 100 |
| 48 | 91.7 | 100 |
| 72 | 85.8 | 96.4 |
| 168 | 7.0 | 76.6 |

This study shows that the bleaching composition of this invention produced no precipitate and was very stable to decomposition at pH 10 after seven days compared to the Control A composition. Samples of commercial color photographic paper processed using this composition and other commercial processing solutions produced the desired image.

EXAMPLE 2–4

Use of Higher Concentrations of Stabilizer Compound

In these examples, the effect of higher levels of stabilizer compound within the present invention was evaluated as well as a combination of the stabilizer compound and a common metal ion sequestering agent, aminotri (methylenephosphonic acid)pentasodium salt (DEQUEST® 2006). The tested compositions, described in TABLE III below, were evaluated as described in Example 1. The compositions were analyzed periodically for the amount of remaining peroxide and for the change in pH. The results of these measurements are shown in TABLE IV below.

TABLE III

| Component | Formulations (mol/l) | | | | |
|---|---|---|---|---|---|
| | Control B | Control C | Example 2 | Example 3 | Example 4 |
| Hydrogen peroxide (30%) | 0.98 | 0.98 | 0.98 | 0.98 | 0.98 |
| Sodium chloride | 0.35 | 0.35 | 0.35 | 0.35 | 0.35 |
| Sodium carbonate | 0.05 | 0.05 | 0.05 | 0.05 | 0.05 |
| 1-Hydroxyethylidene-1,1-diphosphonic acid (DEQUEST ® 2010) | 0.002 | 0 | 0 | 0 | 0 |
| Aminotri(methylenephosphonic acid)pentasodium salt (DEQUEST ® | 0 | 0.002 | 0 | 0 | 0.002 |

TABLE III-continued

| Component | Formulations (mol/l) | | | | |
|---|---|---|---|---|---|
| | Control B | Control C | Example 2 | Example 3 | Example 4 |
| 2006). | | | | | |
| Morpholinomethanediphosphonic acid (Budex 5103) | 0 | 0 | 0.002 | 0.004 | 0.001 |
| pH | 10 | 10 | 10 | 10 | 10 |

TABLE IV

| Time (hours) | $H_2O_2$ Remaining (%) | | | | |
|---|---|---|---|---|---|
| | Control B | Control C | Example 2 | Example 3 | Example 4 |
| 0 | 100 | 100 | 100 | 100 | 100 |
| 72 | 89.55 | 62.45 | 94.58 | 99.02 | 90.93 |
| 168 | 71.12 | 36.82 | 81.73 | 90.46 | 75.36 |

These results show that in the alkaline peroxide bleaching compositions of this invention, the use of morpholinomethanediphosphonic acid alone or in combination with of aminotri(methylenephosphonic acid)pentasodium salt improved the stability of the peroxide bleaching agent over the use common metal ion sequestering agent 1-hydroxyethylidene-1,1-diphosphonic acid or aminotri (methylenephosphonic acid)pentasodium salt alone. Very little change in pH was observed with the invention peroxide compositions.

EXAMPLE 5–7

Stabilizer Compound in Fe (III) Peroxide Bleach

In these examples, the stability of an iron (III)-containing peroxide bleaching compositions was evaluated at pH 4.5 using various concentrations of morpholinomethanediphosphonic acid. The compositions, described in TABLE V below were evaluated as described in Example 1. The bleaching compositions were analyzed periodically for the amount of remaining peroxide and for the change in pH. The results of these measurements are shown in TABLE VI below.

TABLE V

| Component | Formulations (mol/l) | | | |
|---|---|---|---|---|
| | Control D | Example 5 | Example 6 | Example 7 |
| Hydrogen peroxide ( 30%) | 0.25 | 0.25 | 0.25 | 0.25 |
| 2,6-Picolinic acid | 0.02 | 0.02 | 0.02 | 0.02 |
| NaOH to pH of | 3.5 | 3.5 | 3.5 | 3.5 |
| Fe $(NO_3)_3.9H_2O$ | 0.0062 | 0.0062 | 0.0062 | 0.0062 |
| Sodium carbonate to pH of | 3.5 | 3.5 | 3.5 | 3.5 |
| Sodium chloride | 0.25 | 0.25 | 0.25 | 0.25 |
| Morpholinomethanediphosphonic acid (Budex 5103) | 0 | 0.002 | 0.005 | 0.01 |
| Volume | 1 liter | 1 liter | 1 liter | 1 liter |
| Final pH | 3.5 | 3.5 | 3.5 | 3.5 |

TABLE VI

| Time (days) | H2O2 remaining (%) | | | |
|---|---|---|---|---|
| | Control D | Example 5 | Example 6 | Example 7 |
| 0 | 100 | 100 | 100 | 100 |
| 3 | 8.6 | 22.2 | 73.8 | 97.9 |
| 7 | 0 | 0.4 | 62.2 | 95.9 |

These results show that the stability of acidic iron-ligand peroxide bleaching compositions can be significantly improved with the addition of the stabilizing compound according to the present invention. A small increase in pH was observed in the compositions. Samples of a commercial color photographic paper were processed using the Example 6 bleaching composition (and other commercial processing compositions) to provide acceptable color images.

EXAMPLE 9 and 10

Various Peracid Bleaching Compositions

Various peracid bleaching compositions were prepared and evaluated. The compositions, described in the following TABLE VII, were evaluated as described in Example 1. The bleaching compositions were analyzed periodically for the amount of peracid (iodate and persulfate ions) remaining and for the change in pH. The results of these measurements are shown in the following TABLE VIII. After keeping for a period of time, the compositions were used to process samples of commercial color photographic paper to provide acceptable color images.

TABLE VII

| Component | Formulations | | | |
|---|---|---|---|---|
| | Control E | Example 9 | Control F | Example 10 |
| Water | 600 ml | 600 ml | 600 ml | 600 ml |
| Sodium hexametaphosphate | 0 | 0 | 2 g | 2 g |
| Sodium periodate | 2.14 g | 2.14 g | 0 | 0 |
| Sodium persulfate | 0 | 0 | 33 g | 33 g |
| Sodium chloride | 2.93 g | 2.93 g | 15 g | 15 g |
| Sodium dihydrogen phosphate | 0 | 0 | 7 g | 7 g |
| Phosphoric acid (85%) | 0 | 0 | 2.5 ml | 2.5 ml |
| Gelatin | 0 | 0 | 0.3 g | 0.3 g |
| Morpholinomethanediphos- | 0 | 0.005 mol | 0 | 0.005 mol |

TABLE VII-continued

| Component | Formulations | | | |
|---|---|---|---|---|
| | Control E | Example 9 | Control F | Example 10 |
| phonic acid (Budex 5103) | | | | |
| $H_2SO_4$ to pH | 1.28 | 1.28 | ~1 | ~1 |
| Final volume | 1 liter | 1 liter | 1 liter | 1 liter |

TABLE VIII

| Time (days) | Iodate remaining % | | Persulfate remaining (%) | |
|---|---|---|---|---|
| | Control E | Example 9 | Control F | Example 10 |
| 0 | 100 | 100 | 100 | 100 |
| 8 | 100 | 100 | 72.6 | 72.5 |

These results show that the compositions of this invention produced no precipitates. The use of morpholinomethanediphosphonic acid did not negatively impact the stability of the periodate and persulfate bleaching compositions after 8 days. Samples of commercial color photographic paper were processed with these compositions to provide acceptable color images.

The invention has been described in detail with particular reference to certain preferred embodiments thereof, but it will be understood that variations and modifications can be effected within the spirit and scope of the invention.

We claim:

1. A photographic processing kit comprising:

A) a first composition comprising a peracid bleaching agent or a compound that generates or provides a peracid bleaching agent, and B) a second composition comprising a cyclicaminomethanediphosphonic acid or a salt thereof.

2. The photographic processing kit of claim 1 further comprising a third composition that is a photographic color developing composition.

3. The photographic processing kit of claim 1 wherein said second composition further comprises a photographic fixing agent.

4. The photographic processing kit of claim 1 wherein said peracid bleaching agent is a persulfate, periodate, or a peroxide.

5. The photographic processing kit of claim 1 wherein said peracid bleaching agent is hydrogen peroxide or a compound that provides hydrogen peroxide.

6. The photographic processing kit of claim 1 wherein said cyclicaminomethanediphosphonic acid or a salt thereof is morpholinomethanediphosphonic acid or a salt thereof.

7. The photographic processing kit of claim 1 wherein either or both of said first and second compositions comprise an uncomplexed (poly)amino(poly)carboxylic acid, an additional polyphosphonic acid, or a salt of either of these compounds.

8. The photographic processing kit of claim 1 wherein either or both of said first and second compositions comprise a polyaminopolyphosphonic acid or a salt thereof that is represented by the following Structure I:

I

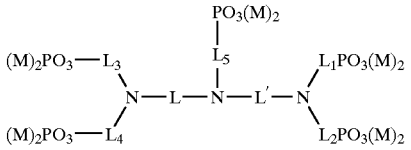

wherein L, L', $L_1$, $L_2$, $L_3$, $L_4$ and $L_5$ are independently divalent aliphatic linking groups independently having from 1 to 4 carbon, oxygen, sulfur or nitrogen atoms in the linking group chain, and M is hydrogen or a monovalent cation.

9. The photographic processing kit of claim 1 wherein either or both of said first and second compositions are in liquid form.

10. The photographic processing kit of claim 1 wherein either or both of said first and second compositions are in solid form.

11. The photographic processing kit of claim 1 wherein said first composition is in liquid form and said peracid bleaching agent is present in an amount of from about 0.005 to about 5 mol/l, and said second composition is in liquid form and said cyclicaminomethanediphosphonic acid or salt thereof is present in an amount of from about 0.00005 to about 0.5 mol/l.

* * * * *